United States Patent [19]

Gutman

[11] 4,436,181

[45] Mar. 13, 1984

[54] ESCAPE SYSTEM

[76] Inventor: David Gutman, 447 Mercy St., Philadelhia, Pa. 19148

[21] Appl. No.: 390,578

[22] Filed: Jun. 21, 1982

[51] Int. Cl.[3] ..... A62B 1/06

[52] U.S. Cl. ..... 182/236; 182/231

[58] Field of Search ..... 182/236, 237, 238, 239, 182/240, 71, 73, 231, 232, 233, 234, 235, 4, 5, 7, 142, 236, 73, 142; 188/382, 65.1, 64; 254/288, 321, 310

[56] References Cited

U.S. PATENT DOCUMENTS

| | | | |
|---|---|---|---|
| 263,723 | 9/1882 | Pike | 182/73 |
| 282,703 | 8/1883 | Collins | 182/73 |
| 321,212 | 6/1885 | Hargrove | 182/142 |
| 497,731 | 5/1893 | Sockman | 188/64 |
| 513,757 | 1/1894 | Carlson | 182/142 |
| 2,526,065 | 10/1950 | Chodacki | 182/236 |
| 4,205,733 | 6/1980 | Wade | 182/142 |

FOREIGN PATENT DOCUMENTS

| | | | |
|---|---|---|---|
| 370520 | 9/1931 | United Kingdom | 254/288 |

*Primary Examiner*—R. P. Machado
*Assistant Examiner*—Alvin Chin-Shue
*Attorney, Agent, or Firm*—Morton J. Rosenberg

[57] ABSTRACT

An escape system (10) for lowering a user mounted thereon in a vertical direction (12) at a predetermined rate of descent responsive to a user applied force in predetermined areas on a seat member (22). The escape system (10) includes a mounting bar member (16) which extends in a longitudinal direction (18). The mounting bar member (16) is secured to a base surface (14) which may be a wall of an edifice, or some other vertically directed surface. A seat member (22) extends in the longitudinal direction (18) which provides containment or a seat for the user. A pair of first and second pulley members (32 and 34) are displaceably coupled to the seat member (22) through a rope element (36) passing between first and second pulley members (32 and 34) and cooperating with seat member (22). A lever bar member (50) is rigidly secured to each of the pulley members (30 and 32) and also extends in longitudinal direction (18) and actuates rotation of the pulley members (30 and 32) when the user applies force load on a first longitudinal end (24) of the seat member (22). Additionally, terminating rotation of the pulley members (30 and 32) is effected when the user applies a force load on the second end (26) of the seat member (22). In this manner, the user by shifting his or her weight can control the actuation of the rotation of the pulley members (30 and 32) and consequently the rate of descent in the vertical direction (12).

10 Claims, 9 Drawing Figures

FIG. 4
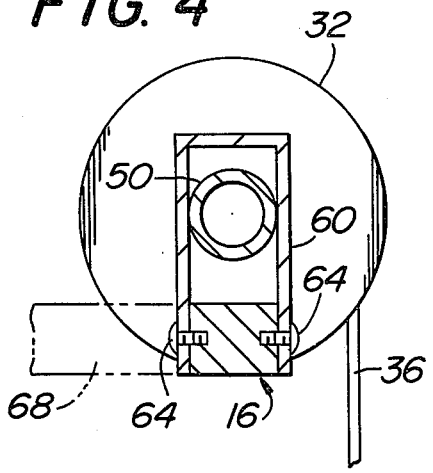
FIG. 5
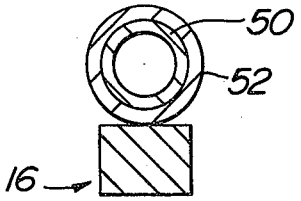
FIG. 6
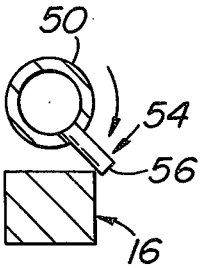
FIG. 7
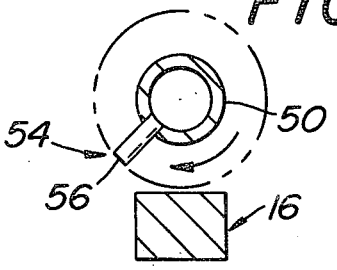
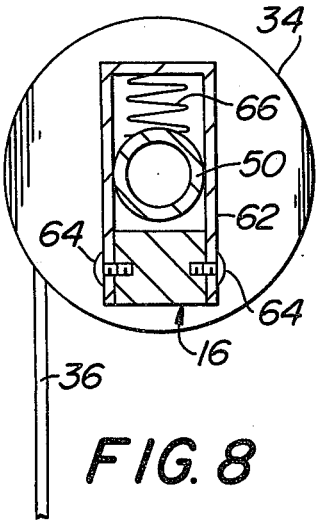
FIG. 8
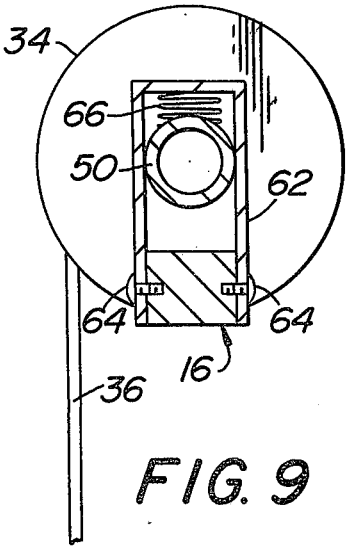
FIG. 9

ESCAPE SYSTEM

BACKGROUND OF THE INVENTION

1. Field of the Invention

This invention pertains to scaffolding type systems which may be lowered in the vertical direction through actuation of a user. In particular, this invention directs itself to escape systems where the user by shifting his or her weight in a particular longitudinal direction is able to control the rate of descent of a seat member. Further, this invention directs itself to an escape system having a pair of displaced pulley members which cooperate with a seat member and allows a predetermined rate of descent, dependent upon the force loading area upon which the user applies the force. More in particular, this invention relates to a lever actuated pulley system having a stop control dependent upon the inclination of a lever bar.

2. Prior Art

Escape systems are known in the prior art. However, many prior art systems are complicated mechanisms which increase the cost of manufacture and are installed in edifices at great expense.

Some prior art escape systems rely on ladder type elements which are generally metastable and may cause the user to fall during the descent due to the hurried manner in which a user generally leaves an edifice in a fire or other hazardous condition.

Some other prior art systems direct themselves to chute type escapes which are generally unwieldy to maintain and ofttimes do not provide for a controlled rate of descent dependent upon a responsive load force applied by the user.

Other prior art systems are bulky devices which cannot be easily stored and provide for inconvenience to the user when such are not in use.

SUMMARY OF THE INVENTION

An escape system for vertically lowering the user at a controlled rate of descent, responsive to a user applied force. The escape system includes a mounting bar member extending in a longitudinal direction. The mounting bar member is fixedly secured to a base surface. A seating mechanism extends in the longitudinal direction for providing a seat for the user. A pulley mechanism is displaceably coupled to the seating mechanism on opposing longitudinal ends thereof. A lever mechanism is secured to the pulley mechanism on opposing ends thereof for (1) actuating rotation of the pulley mechanism when the user applies a force load on a first longitudinal end of the seating mechanism, and (2) terminating rotation of the pulley mechanism when the user applies a force load on a second longitudinal end of the seating mechanism.

BRIEF DESCRIPTION OF THE DRAWINGS

FIG. 4 is a cross-sectional view of the escape system taken along the Section Line 4—4 of FIG. 3;

FIG. 5 is a cross-sectional view of the lever bar member taken along the Section Line 5—5 of FIG. 3;

FIG. 6 is a cross-sectional view of the lever bar member and the mounting bar member taken along the Section Line 6—6 of FIG. 3;

FIG. 7 is a cross-sectional view of the lever bar member and the mounting bar member taken along the Section Line 7—7 of FIG. 2;

FIG. 8 is a sectional view of the escape system showing the U-shaped channel constraining members taken along the Section Line 8—8 of FIG. 3; and FIG. 9 is a sectional view of the escape system taken along the Section Line 9—9 of FIG. 2.

DESCRIPTION OF THE PREFERRED EMBODIMENTS

Figure 1:
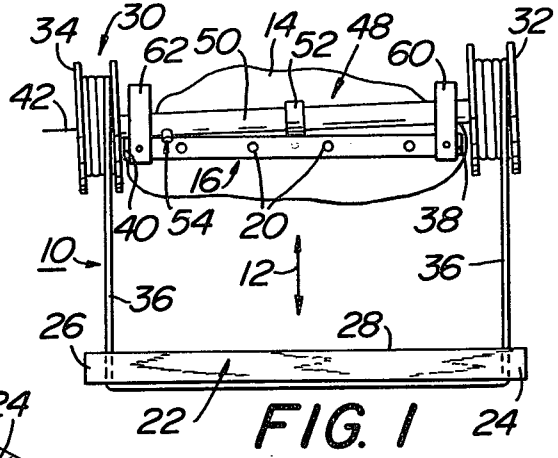
FIG. 1 is a frontal view of the escape system showing an inclination of a lever bar member for terminating rotation of the pulley member.
Figure 2:
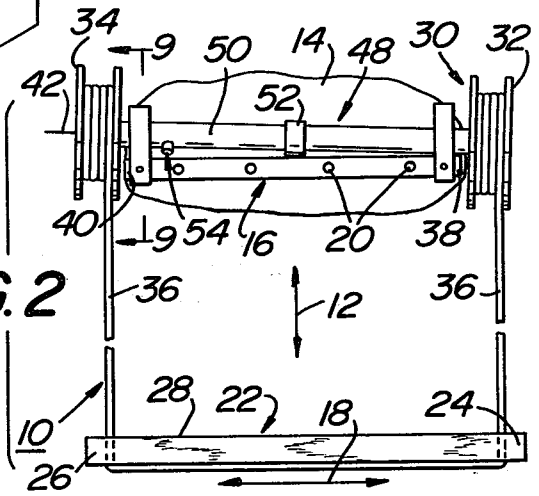
FIG. 2 is a frontal view of the escape system showing an inclination of the lever bar member for permitting rotation of the pulley member.
Figure 3:
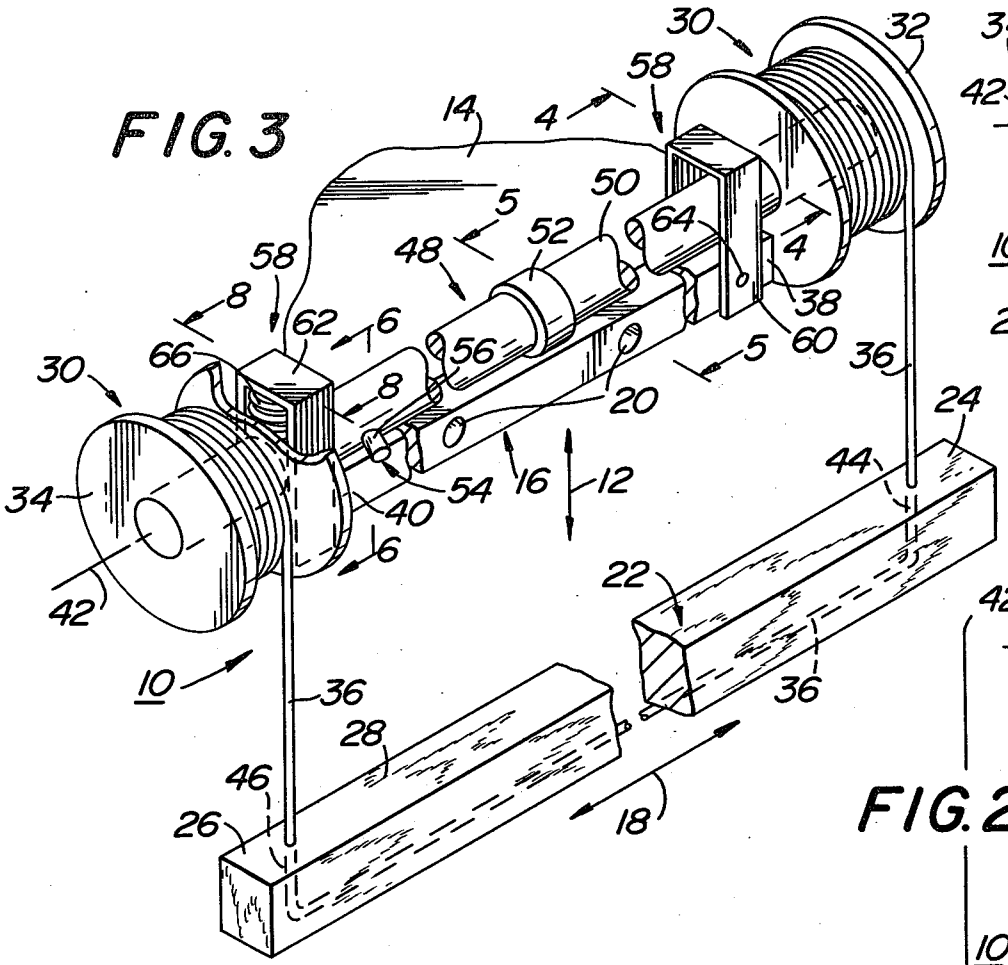
FIG. 3 is a perspective view of the escape system being partially cut away.

Referring now to FIGS. 1-9, there is shown escape system 10 for lowering a user in vertical direction 12 at a controlled rate of descent responsive and under the control of a user applied force. In general, escape system 10 may be used as a scaffolding system or in any other system where a user has need of a stable platform which may be lowered. In particular, escape system 10 is directed to a fire escape mechanism whereby a user may egress an edifice and lower himself/herself to the ground in an expeditious and safe manner. Further, as will be seen in following paragraphs, escape system 10 provides for a simple mechanism which allows the user to control the rate of descent responsive to his or her force application at particular locations on escape system 10. Escape system 10 may be mounted to base surface 14 as shown in FIG. 3 where base surface 14 may be the wall of an edifice or may be internal to the edifice located under a window sill.

Escape system 10 includes mounting bar member 16 which extends in longitudinal direction 18. Mounting bar member 16 is fixedly secured to base surface 14 through bolts 20 or some like mechanism, not part of the inventive concept. As herein detailed, with the exception being that bolts 20 are sufficient in structural integrity to maintain the weight of a user. Mounting bar member 16 may be formed of steel, wood, or some like material having a structural integrity sufficient to support the weight of a user being lowered thereon. In general, mounting bar member 16 may have a cross-sectional area of a square, rectangle, or some like overall contour generally with a planar area facing base surface 14.

Escape system 10 further includes seat member 22 which extends in longitudinal direction 18 as is clearly seen in FIGS. 1-3. Seat member 22 includes first end 24 and second end 26, as is clearly seen in FIGS. 1-3. Seat member 22 essentially defines a platform for retaining the user during his or her descent in vertical direction 12. Platform or seat member 22 may be used by the operator while standing or sitting on upper seat surface 28. Seat member 22 is shown as a bar member in FIG. 3, however, seat member 22 may take the form of a scaffolding member, board member, or any like contour not important to the inventive concept as is herein described, with the exception that there generally be an upper seat surface 28 for supporting the load of a user and that such contour allow the user to shift his or her weight in reversible longitudinal direction 18 for purposes to be described in following paragraphs. Additionally, seat member 22 may be formed of wood, steel, or other like metallic or plastic composition which composition would have the structural integrity to support the load weight of a user mounted on upper seat surface 28 during operation of escape system 10.

As shown in FIGS. 1-3, there is further provided pulley mechanism 30 which is displaceably coupled to seat member 22 on opposing longitudinal ends 24 and 26 of seating member 22. Pulley mechanism 30 is displaceably and inclinably mounted with respect to mounting bar member 16 which is fixed to base surface 14. However, the displaceable inclined motion of pulley mechanism 30 with respect to mounting bar 16 will be described in following paragraphs. Substantially, pulley mechanism 30 is restrained or constrained to mounting bar member 16 in a manner to be described.

Seat member 22 moves in vertical direction 12 responsive to rotation of pulley mechanism 30 through extended vertical dimensions. Pulley mechanism 30 includes first pulley member 32 mounted longitudinally external to mounting bar member 16 at mounting bar member first end section 38. Additionally, second pulley member 34 comprising a portion of pulley mechanism 30 is mounted longitudinally external mounting bar member 16 at mounting bar member second end 40. Thus, first and second pulley members 32 and 34, respectively, are free to rotate about axis 42 which is an axis parallel to longitudinal direction 18, as is shown in the Figures.

Rope member 36 is rotatably mounted to first and second pulley members 32 and 34. As is seen, rope member 36 is respectively wrapped around each of pulley members 32 and 34 wherein rotation of pulley members 32 and 34 about axis 42 allows rope member 36 to be played out or reeled in. Additionally, rope member 36 passes through first end through opening 44 and second end through opening 46 of seat or platform member 22, as is clearly seen in FIG. 3. Rope member 36 passes beneath seat member 22 to join first and second pulley members 32 and 34 of pulley mechanism 30. Rope member 36 is slidably coupled to seat member 22, thus, rope members 36 may be vertically displaced within first and second end through openings 44 and 46 of seat member 22. This movement will allow shifting of rope member 36 with respect to seat member 22 and aid in keeping seat member 22 in a substantially horizontal plane when the user applies load to first end 24 or second end 26 of seat member 22.

Escape system 10 further includes lever mechanism 48 secured to pulley mechanism 30 on opposing ends thereof for alternately actuating rotation of pulley mechanism 30 when the user applies a force load on first longitudinal end 24 of seating member 22 and terminating rotation of pulley mechanism 30 when the user applies a force load on second longitudinal end 26 of seat member 22. Lever mechanism 48 includes lever bar member 50 which may be in the form of a shaft or tubular member in cross-sectional area. Lever bar member 50 is fixedly secured to first and second pulley members 32 and 34 respectively on opposing longitudinal ends thereof. However, lever bar member 50 is rotatively displaceable with respect to mounting bar member 16 and is positionally located adjacent, but above, mounting bar member 16 as is shown in FIGS. 1-4 and 8-9.

Lever mechanism 48 includes pivot member 52 shown in FIGS. 1-3 and 5. Pivot member 52 is seen to be mounted substantially in a central section of the longitudinal extension of lever bar member 50 for permitting inclination of lever bar member 50 with respect to mounting bar member 16. As is seen in FIGS. 1 and 2, pivot member or collar member 52 is contiguous to an upper surface of mounting bar member 16 and may be inclined in opposing directions as shown in FIGS. 1 and 2 with respect to horizontally directed mounting bar member 16. As can be seen, if a user applies a load near second end of seat 26, inclination of lever bar member 50 is provided in a direction shown by FIG. 1. In opposition, where the user applies a load on seat member 22 near first end 24 of seat or platform member 22, the inclination of lever bar member 50 is provided in a direction shown by FIG. 2. The significance of opposing inclinations as described by FIGS. 1 and 2 will be seen in following paragraphs. Collar member 52 is secured to an external peripheral wall of lever bar member 50 through shrink fitting, bolting, or some like mechanism not important to the inventive concept as herein described, with the exception that collar member 52 should be fixedly secured to lever bar member 50. Both lever bar member 50 and pivot or collar member 52 may be formed of steel, or other metal having structural integrity sufficient to sustain the load forces of a user. It is to be further understood that in order to incline lever bar member 50 in opposing directions as shown in FIGS. 1 and 2, a user need not necessarily apply loads precisely at first and second ends 24 and 26 of seat member 22, however, in order to provide inclination in a desired direction, force load must be applied on a particular side of pivot member or collar member 52.

Referring now to FIGS. 1-3, 6 and 7, there is shown pulley rotation control mechanism 54 for terminating rotation of first and second pulley members 32 and 34 responsive to a user applied force load to second end 26 of seat member 22. Additionally, pulley rotation control mechanism 54 also initiates rotation of pulley members 32 and 34 responsive to a user applied force load to first end 24 of seat member 22. Pulley rotation control mechanism 54 includes lug member 56 which is secured to lever bar member 50 and extends outwardly in a radial direction from the peripheral wall of lever bar member 50.

In operation, when termination of rotation of pulleys 32 and 34 is desired, the user applies a force load to second end 26 of seat member 22 while mounted thereon. This force loading allows pivoting about pivot member or collar member 52 and inclination of lever bar member 50 is provided, as is shown in FIG. 1. As can be seen in FIG. 6, lug member 56 of pulley rotation control mechanism 54 extends from lever bar member 50 through a distance such that lug member 56 contacts mounting bar member 16 to terminate rotation of lever bar member 50 and consequently pulley members 32 and 34.

In opposition, when the user wishes to initiate rotation of pulleys 32 and 34, a force loading is applied to first end 24 of seat member 22. The orientation and inclination of lever bar member 50 is as shown in FIG. 2. In this configuration as is further provided in the cross-sectional FIG. 7, lug member 56 has clearance with respect to mounting bar member 16 and rotation of pulleys 32 and 34 is provided.

It is to be understood that the force loading applied by the user may be in the general area of either first end or second ends 24 and 26. Of importance, is that the load be applied on the proper longitudinal side of pivot member 52.

Escape system 10 further includes capturing mechanism 58 for capturing lever mechanism 48 and in particular lever bar member 50 with respect to mounting bar member 16 in vertical direction 12. Capturing mechanism 58 is provided to allow limited vertical displacement of lever bar member 50 with respect to mounting bar member 16 while at the same time constraining lever bar member 50 in a direction transverse to longitudinal direction 18.

Capturing mechanism 58 includes first and second U-shaped channel members 60 and 62 as is clearly seen in FIGS. 1–3, 4, and 8, 9. First and second U-shaped channel members 60 and 62 are mounted to opposing transverse sides of mounting bar member 16 in an inverted manner through U-shaped channel member bolts 64. The mode or method of securing first and second U-shaped channel members 60 and 62 to mounting bar member 16 is not important to the inventive concept as herein described, with the exception that such mounting should fixedly secure channel members 60 and 62. Additionally, channel members 60 and 62 pass upwardly in a manner such that limited vertical travel of lever bar member 50 is accepted when lever bar member 50 is pivoted about pivot or collar member 52.

As shown in FIGS. 3, 8 and 9, escape system 10 further includes spring member 66 which compressively is mounted between an undersurface of second U-shaped channel member 62 and an upper surface of lever bar member 50. Spring member 66 provides for a biasing force applied to the upper surface of lever bar member 50 in order to maintain escape system 10 in a locked or terminated rotation mode for pulleys 32 and 34. Thus, without any external load being applied to upper seat surface 28, the inclination of lever bar member 50 will be that as shown in FIG. 1 with lug member 56 interfacing with mounting bar member 16. This biasing mechanism insures that upon a no load condition, that the seat member 22 will not in itself move in a downward or vertical direction 12 prior to use by the user.

Additionally, due to the fact that pulley members 32 and 34 generally have a larger diameter than the width of mounting bar member 16 or associated U-shaped channels 60 and 62, a base surface interface member 68 such as that shown in FIG. 4 may be used to mount mounting bar member 16 to base surface 14. Interface member 68 may simply be a pair of extending bar members which are fixedly secured to base surface 14 and mounting bar member 16 to provide clearance for pulleys 32 and 34 from base surface 14.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. An escape system for vertically lowering a user at a predetermined rate of descent responsive to a user applied force, comprising:

(a) a mounting bar member extending in a longitudinal direction, said mounting bar member being fixedly secured to a base surface;

(b) seating means extending in said longitudinal direction for providing a seat for said user;

(c) pulley means displaceably coupled to said seating means on opposing longitudinal ends thereof; and, (d) lever means secured to said pulley means on opposing ends thereof for (1) actuating rotation of said pulley means when said user applies a force load on a first longitudinal end of said seating means, and (2) terminating rotation of said pulley means when said user applies a force load on a second longitudinal end of said seating means.

2. The escape system as recited in claim 1 where said pulley means includes:

(a) a first pulley member mounted longitudinally external said mounting bar member on a first end thereof;

(b) a second pulley member mounted longitudinally external said mounting bar member on a second end thereof; and, (c) rope means rotatively mounted to said first and second pulley member, said rope means being slidably coupled to said seating means.

3. The escape system as recited in claim 2 where said seating means includes a platform member, said platform member being displaceably coupled to said first and second pulley members by said rope means.

4. The escape system as recited in claim 2 including means for capturing said lever means with respect to said mounting bar member, said lever means being inclinably displaceable with respect to said mounting bar member in said vertical direction.

5. The escape system as recited in claim 4 where said lever means includes a lever bar member fixedly secured to said first and second pulley members on opposing longitudinal ends thereof, said lever bar member being rotatively displaceable with respect to said mounting bar member.

6. The escape system as recited in claim 5 where said lever means includes pivot means mounted substantially in a central section of said longitudinal extension of said lever bar member for permitting inclination of said lever bar member with respect to said mounting bar member.

7. The escape system as recited in claim 6 where said pivot means includes a collar member secured to said lever bar member at substantially said central section of said lever bar member.

8. The escape system as recited in claim 7 where said lever means includes pulley rotation control means for (1) terminating pulley rotation when said user applies a force load to said second end of said seating means, and (2) initiating pulley rotation when said user applies said force load to said first end of said seating means.

9. The escape system as recited in claim 8 where said pulley rotation control means includes a lug member secured to said lever bar member and extending outwardly from a peripheral wall, said lug member for constraining rotation of said lever bar member with respect to said mounting bar member when said force load is applied to said second end of said seating means.

10. The escape system as recited in claim 9 where said means for capturing said lever means includes a pair of longitudinally displaced U-shaped channel members secured to said mounting bar member, said lever member being vertically displaceable within said channels.

* * * * *